US005176184A

United States Patent [19]

Yamada

[11] Patent Number: 5,176,184

[45] Date of Patent: Jan. 5, 1993

[54] PICKING CONTROL DEVICE WITH PRESSURE CORRECTING APPARATUS

[75] Inventor: Shigeo Yamada, Komatsu, Japan

[73] Assignee: Tsudakoma Kogyo Kabushiki Kaisha, Kanazawa, Japan

[21] Appl. No.: 718,982

[22] Filed: Jun. 21, 1991

[30] Foreign Application Priority Data

Jun. 27, 1990 [JP] Japan ..... 2-170469

[51] Int. Cl.[5] ..... D03D 47/30

[52] U.S. Cl. ..... 139/435.2; 139/1 E

[58] Field of Search ..... 139/435.1, 435.2, 1 E, 139/435.5

[56] References Cited

U.S. PATENT DOCUMENTS 4,732,179 3/1988 Takegawa ..... 139/435.2
4,827,990 5/1989 Takegawa ..... 139/435.2
4,830,063 5/1989 Takegawa ..... 139/435.2

FOREIGN PATENT DOCUMENTS 234064 9/1987 European Pat. Off. .
263445 4/1988 European Pat. Off. .
276829 8/1988 European Pat. Off. .
333155 9/1989 European Pat. Off. .
2118138 5/1990 Japan .

OTHER PUBLICATIONS

Patent Abstracts of Japan vol. 330, No. 014 Jul. 16, 1990 & JP-A-63 268 080 (Nissan Motor Co.) Oct. 26, 1988 *The Whole Document*.

*Primary Examiner*—Andrew M. Falik
*Attorney, Agent, or Firm*—Oblon, Spivak, McClelland, Maier & Neustadt

[57] ABSTRACT

A picking control device for a loom comprising a pressure controller for controlling jet pressure of a picking nozzle, a timing controller for controlling operation time of a picking member, angle corrector for correcting the start angle of the weft yarn and a condition setting section which is operated on the condition that one of the signals from the pressure controller or angle corrector is not present so that at least one of the jet pressure, start angle or speed of the loom is maintained at an optimum value. This allows for effective picking with adequate air consumption and helps to prevent weaving defects such as cutting of the weft yarn at the time of termination of picking, warp engagement and the like.

2 Claims, 4 Drawing Sheets

PICKING CONTROL DEVICE WITH PRESSURE CORRECTING APPARATUS

BACKGROUND ART

This invention relates to a picking control device in a loom in which in an air jet loom, even when the flying characteristic of weft yarn is varied, stable picking operation can be continued.

In the air jet loom, when the flying characteristic of weft yarn used for weaving is varied, picking sometimes becomes unstable. It is considered that such unstable picking as just mentioned principally results from change in air resistance of yarns since yarn properties such as coarseness of yarns, sizes of fuzz and the like are varied lengthwise of weft yarn.

In view of the above, various procedures have been proposed in an attempt of continuing the stable picking operation even when the flying characteristic of weft yarn is varied. The most typical procedure is designed so as to monitor a loom mechanical angle (hereinafter referred to as "arrival angle") wherein in picking, an end of weft yarn arrives at the anti-picking side, and controls a loom mechanical angle (hereinafter referred to as "start angle") for starting the picking operation and jet pressure of picking main nozzle and sub-nozzle.

In the aforementioned method, when the flying characteristic of weft yarn lowers so that the lagging of the arrival angle is detected, a control is made so as to make fast the picking start angle and increase the jet pressure in order to correct the lagging of the arrival angle. On the other hand, with respect to the leading of the arrival angle, the picking start angle is retarded and the jet pressure is decreased to thereby maintain the arrival angle constant whereby a better result can be obtained, than the case where only one of the start angle and jet pressure comprises an object to be controlled.

A further proposal is that an upper limit value is set to the jet pressure, and only when the jet pressure controlled by a deviation of the arrival angle exceeds the upper limit value, a control is made so that the start angle is held fast (Japanese Patent Laid-open No. 2 (1990)-118138 publication).

Incidentally, generally, when the jet pressure is excessively low, unevenness of the deviation of the arrival angle for each picking increases, and as a result, the flying of the weft yarn becomes unstable and a weft stop is apt to occur. Conversely, when the jet pressure is excessively high, at the time of termination of picking, a so-called cutting of the weft yarn at the time of termination of picking is apt to occur as well as occurrence of fuzz stripes on the fabrics and in addition, air consumption is excessively large, which is uneconomical. Accordingly, it is desired that the optimum value of the jet pressure be set to a low value at which no weft stop occurs.

On the other hand, when the start angle is excessively fast, the warp shedding is not sufficiently formed and weft engagement is apt to occur but it is advantageous that the start angle is as fast as possible in view of securing the sufficient flying time of weft yarn. The optimum value is present in the case where the start angle is fast in consideration of the above matter.

That is, the jet pressure and the start angle are advantageously as close as possible to these optimum values, reducing occurrence of inferior weaving such as restriction cutting, weft engagement with warp yarn and the like. Thus stable operation can be continued.

However, employment of the aforementioned prior art poses a problem in that it is difficult to coincide the jet pressure and the start angle with the optimum value and the stable operation cannot be continued with a sufficient scope. That is, in the case where correction signals (i.e., based upon a fast or slow arrival angle); are merely applied in parallel to control systems for controlling the start angle and the jet pressure or when one exceeds the upper limit value, a correction signal is applied to the other, such that stable picking could be realized, however the jet pressure and the start angle at that time are possibly greatly shifted from the respective optimum values since no means are provided for setting them to the optimum value. In other words, the operation is sometimes continued in the state where the jet pressure and the start angle are greatly deviated from the respective optimum values, at which time a scope for achieving the stable picking is small, and most likely, air consumption unreasonably increases.

SUMMARY OF THE INVENTION

In view of the problem as noted above with respect to prior art, it is an object of this invention to provide a picking control device for a loom wherein a set pressure or a set start angle (or set speed) having an optimum value is corrected and controlled for allowing output the of the other whereby at least one of the jet pressure or start angle (or speed of the loom) is maintained at an optimum value for setting the arrival angle to the target level, and a stable picking operation can be continued with sufficient scope and appropriate air consumption.

For achieving the aforesaid object, the first invention according to this application is principally configured by comprising a pressure controller for controlling jet pressure of a picking nozzle, a timing controller for controlling operation time of a picking member and a condition setting section, said condition setting section comprising a deviation detection means for calculating a deviation of an arrival angle from an arrival angle of filling yarns and a set arrival angle, a pressure correction means for outputting a pressure correction signal for correcting a set pressure in response to the deviation of arrival angle to the pressure controller, and an angle correction means for outputting an angle correction signal for correcting a set start angle in response to the deviation of arrival angle to the timing controller, said pressure correction means and said angle correction means outputting a pressure correction signal and an angle correction signal on condition that the angle correction signal and pressure correction signal are not present.

The second invention is principally configured by using a speed controller for controlling a speed of a loom in place of the timing controller of the first invention, the condition setting section comprising a speed correction means for outputting a speed correction signal for correcting a set speed to the speed controller, said speed correction means outputting a speed correction signal on condition that a pressure correction signal is not present.

DETAILED DESCRIPTION OF THE INVENTION

Embodiments of this invention will be described hereinafter with reference to the drawings.

Figure 2:
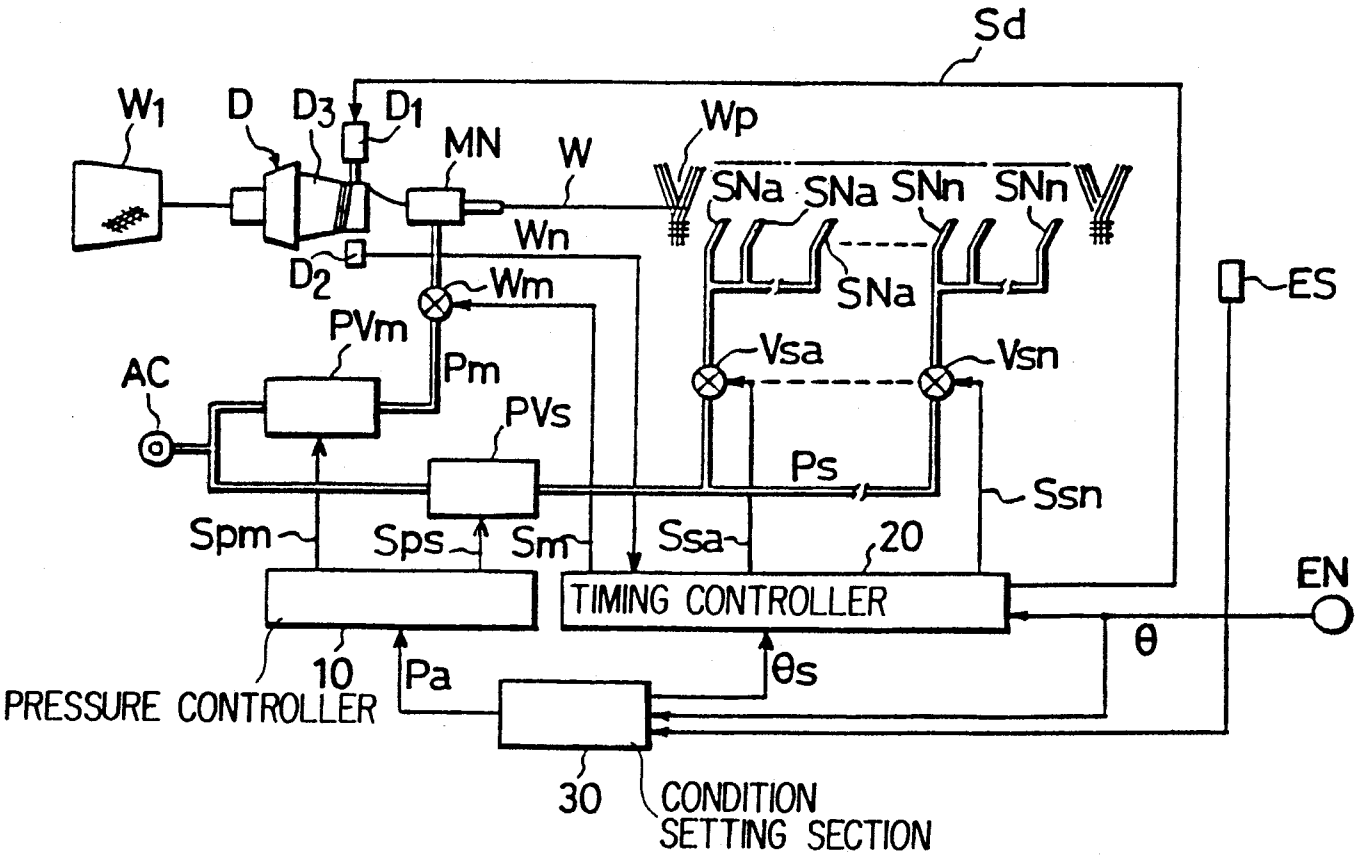
FIG. 2 is an overall structural view of a loom control system to which is applied the control device shown in FIG. 1.

The loom comprises an air jet loom as shown in FIG. 2. The weft yarn W released from a supply package 1 is picked into a warp opening Wp via a drum type weft length-measuring and storage device (hereinafter merely referred to as the storage device) D and a main nozzle MN. Sub-nozzles SNi (i=a, b . . . n) divided into plural groups are disposed along the travel route of the weft yarn W.

The storage device D includes an engaging pin drive D1 and a release sensor D2. The weft yarn W wound about and stored on a drum D3 is subjected to picking by driving the engaging pin drive D1 to a release position and opening open-close valves Vm, Vsi (i=a, b . . . n) to actuate the main nozzle MN and the sub-nozzles SNi in response to picking signals Sd, Sm and Ssi (i=a, b . . . n) from a timing controller 20, and the picking length Wn is measured by the release sensor D2.

The main nozzle MN and sub-nozzles SNi are connected to a common air source AC via the open-close valves Vm and Vsi and pressure regulating valves PVm and PVs, and jet pressures Pm and Ps are controlled by control signals Spm and Sps from a, pressure controller 10. On the anti-picking side of the loom is disposed a weft feeler ES for detecting the picked weft yarn W, and an output thereof is input into a condition setting section 30. Furthermore, a loom mechanical angle $\theta$ from an encoder EN connected to a main shaft of the loom is branched and input into the condition setting section 30 and the timing controller 20.

Figure 1:
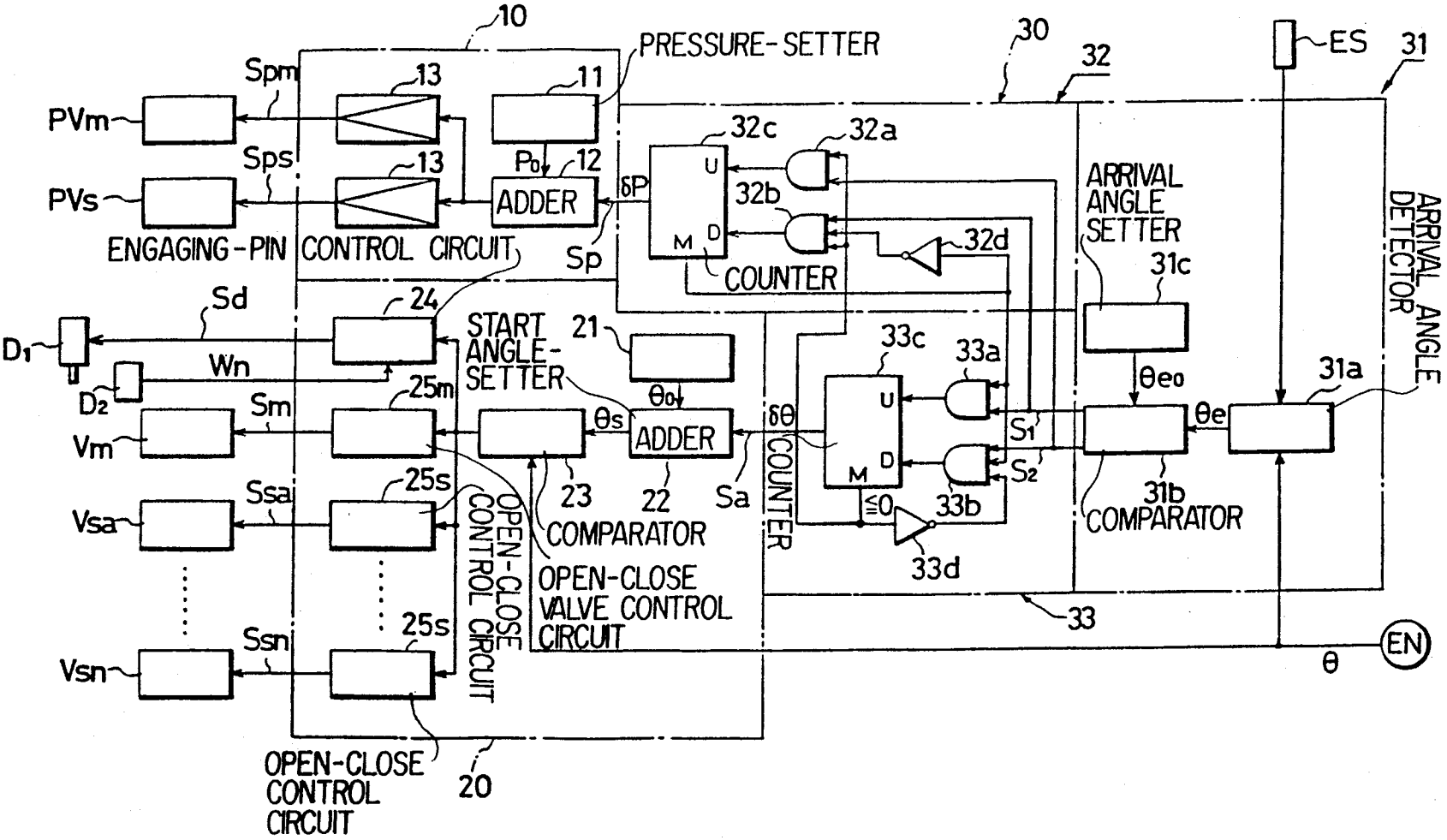
FIG. 1 is an overall systematic view showing one embodiment of a control device according to the present invention.

The picking control device for the loom comprises pressure controller 10, timing controller 20 and condition setting section 30 as shown in FIG. 1, the condition setting section 30 comprising a deviation detection means 31, a pressure correction means 32 and an angle correction means 33.

The pressure controller 10 comprises a pressure setter 11, an adder 12, and two control amplifiers 13, 13, and an output thereof is input, as control signals Spm and Sps, into the pressure regulating valves PVm and PVs. A set pressure Po from the pressure setter 11 and a pressure correction signal Sp from the condition setting section 30 are input into the adder 12.

The timing controller 20 comprises a start angle setter 21, an adder 22, a comparator 23, an engaging pin control circuit 24, and open-close valve control circuits 25*m*, 25*s*, 25*s* . . . A set start angle $\theta$o from the start angle setter 21 and an angle correction signal Sa from the condition setting section 30 are input into the adder 22, and an output of the adder 22 and a loom mechanical angle $\theta$ from the encoder EN are input into the comparator 23. The picking length Wn from the release sensor D2 is input into the engaging pin control circuit 24, and an output thereof is input, as a picking signal Sd, into the engaging pin drive D1. Outputs of the open-close valve control circuits 25*m*, 25*s*, 25*s* . . . are input, as picking signals Sm and Ssi, into the open-close valves Vm and Vsi.

A deviation detection means 31 in the condition setting section 30 comprises an arrival angle detector 31*a*, a comparator 31*b* and an arrival angle setter 31*c*, and an output from the picking feeler ES and a loom mechanical angle $\theta$ from the encoder EN are input into the arrival angle detector 31*a*. An arrival angle $\theta$e from the arrival angle detector 31*a* and a set arrival angle $\theta$eo from the arrival angle setter 31*c* are input into the comparator 31*b*. The comparator 31*b* calculates an arrival angle deviation $_{\Delta}\theta$e as $_{\Delta}\theta e=\theta eo-\theta e$, and outputs a leading signal S1 when $_{\Delta}\theta e>0$ and a lagging signal S2 when $_{\Delta}\theta e<0$ to the pressure correction means 32 and the angle correction means 33, respectively.

The pressure correction means 32 and the angle correction means 33 are formed by the same circuit configuration, each of which comprises AND gates 32*a*, 32*b*, 33*a*, 33*b*, counters 32*c*, 33*c*, and inverters 32*d*, 33*d*.

Accordingly, a leading signal S1 and a lagging signal S2 from the deviation detection means 31 are branched and input into the AND gates 32*b*, 33*a* and the AND gates 32*a*, 32*b*, and outputs of the AND gates 32*a* and outputs of the AND gates 32*b*, 33*b* are connected to addition terminals U' ' subtraction terminals D of the counters 32*c*, 33*c*. Minus terminals M, M indicating that contents of the counter 32*c*, 33*c* is zero or negative are feedback-connected to the AND gates 32*b*, 33*b* through the inverters 32*d*, 33*d*, and the terminal M of the counter 32*c* and the minus terminal N of the counter 33*c* are cross-connected to the AND gates 33*a*, 33*b* and the AND gates 32*a*, 32*b*, respectively. Outputs of the counters 32*c*, 33*c* are in the form of a pressure correction signal Sp and an angle correction signal Sa, respectively, with respect to the pressure controller 10 and the timing controller 20.

When the contents of counter 32*c*, 33*c* is zero or negative, output $\delta P$, $\delta\theta$ of the counter is stopped.

The control operation carried out by the aforementioned control device will be described hereinafter.

It is now assumed that the pressure correction signal Sp and the angle correction signal Sa from the condition setting section 30 are not present, their values being zero. Picking is started, for the weft yarn W, at the set start angle $\theta$o set to the start angle setter 21 of the timing controller 20, and the weft yarn W arrives at the anti-picking side at the set arrival angle $\theta$eo set to the arrival angle setter 31*c* of the deviation detection means 31, and the weft yarn W is picked by the set jet pressure Po to the pressure setter 11. That is, since at that time, the arrival angle $\theta$e is $\theta e=\theta eo$, the arrival angle deviation $_{\Delta}\theta$e is $_{\Delta}\theta e=\theta eo-\theta e=0$, and accordingly, in the comparator 31*b*, neither leading signal S1 or lagging signal S2 is output.

The comparator 23 of the timing controller 20 compares the start angle $\theta$s ($\theta s=\theta o$) input through he adder 22 with the loom mechanical angle $\theta$, and at the time of $\theta=\theta s$ ($=\theta o$), a signal for starting the engaging pin control circuit 24 and the open-close control circuits 25*m*, 25*s*, 25*s* . . . is output to actuate the engaging pin drive D1 and the open-close valves Vm and Vsi so that the picking of the weft yarn W can be started. The return operation of the engaging pin is controlled by the engaging pin control circuit 24 corresponding to the picking length Wn from the release sensor D2, and the open time control of the open-close valves Vm and Vsi is carried out by the open-close control circuits 25*m*, 25*s*, 25*s* . . .

On the other hand, the pressure controller 10 controls so that the jet pressures Pm and Ps of the main nozzle MN and the sub-nozzles SNi realized by the pressure regulating valves PVm and PVs coincide with the set pressure Po set to the pressure setter 11. At that time, however, the set pressure Po and the set start angle $\theta o$ have been set to the optimum pressure and optimum loom mechanical angle, respectively, necessary for realizing the normal picking operation (see area A in FIG. 3).

When the flying characteristic of the weft yarn W is enhanced (as shown in the area B of FIG. 3) for some reason, and the arrival angle $\theta e$ is faster than the set arrival angle $\theta eo$, the deviation detect means 31 detects the arrival angle deviation $_{\Delta}\theta e$ ($_{\Delta}\theta e = \theta eo - \theta e > 0$) to output the leading signal S1 to the pressure correction means 32 and the angle correction means 33.

Then, the leading signal S1 is input into the AND gate 32*b* of the pressure correction means 32 and the AND gate 33*a* of the angle correction means 33, and the former has been closed through the inverter 32*d* since the content of the counter 32*c* has been zero whereas the latter has been open. Accordingly, the leading signal S1 arrives at the addition terminal U of the counter 33*c* through the AND gate 33*a* to increase the content of the counter 33*c* in a positive direction by a predetermined quantity. As a result, the minus terminal M of the counter 33*c* assumes a low level to close both the AND gates 32*a* and 32*b* of the pressure correction means 32 and open the AND gate 33*b* through the inverter 33*d*. Thereafter, the leading signal S1 and the lagging signal S2 from the deviation detection means 31 arrive at the addition terminal U and the subtraction terminal D of the counter 33*c* from the angle correction means 33 but do not arrive at the counter 32*c* of the pressure correction means 32.

On the other hand, an increase in a positive direction in the counter 33*c* is converted into a suitable start angle correction quantity $\delta\theta$, which is then output as an angle correction signal Sa to the adder 22 of the timing controller 20. So the timing controller 20 can take place the picking operation with the start angle $\theta s$ as $\theta s = \theta o + \delta\theta$, the start angle $\theta s$ at that time being corrected in a slow direction with respect to the set start angle $\theta o$. Thereby, the arrival angle $\theta e$ is immediately corrected to the set arrival angle $\theta eo$.

When the flying characteristic of the weft yarn W further increases to become faster, the leading signal S1 is continuously output from the deviation detection means 31, and therefore, the content of the counter 33*c* further increases accordingly and the angle correction signal Sa from the angle correction means 33 outputs a larger start angle correction quantity $\delta\theta$ to the timing controller 20 whereby the arrival angle $\theta e$ is maintained at the set arrival angle $\theta eo$.

Figure 3:
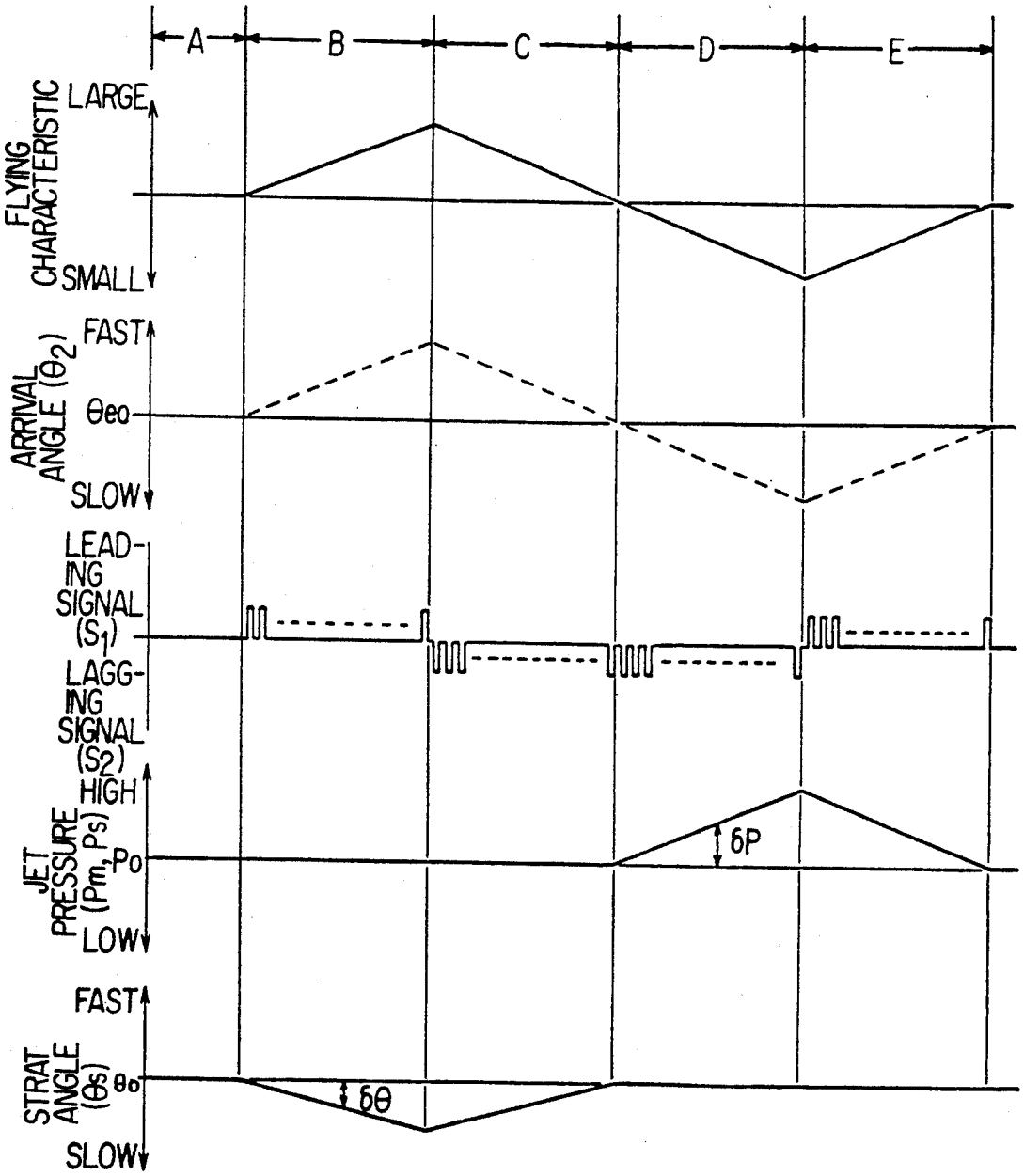
FIG. 3 is a diagram for explaining the operation of FIGS. 1 and 2.

When the flying characteristic of the weft yarn W is turned to the decreasing trend as in area C of FIG. 3, a lagging signal S2 is output from the deviation detection means 31 whereby the content of the counter 33*c* decreases and therefore the start angle correction quantity $\delta\theta$ with respect to the timing controller 20 also gradually decreases.

When the flying characteristic of the weft yarn W further decreases so that the content of the counter 33*c* is zero as shown in area D of FIG. 3, the start angle correction quantity $\delta\theta$ is $\delta\theta = 0$, and the start angle $\theta s$ by the timing controller 20 returns to the set start angle $\theta o$ which is the optimum value. At this time, the counter 33*c* is zero whereby the And gate 33*b* is closed and the AND gate 32*a* is opened.

When the flying characteristic further lowers, the lagging signal S2 arrives at the addition terminal U of the counter 32*c* of the pressure correction means 32 through the newly opened AND gate 32*a*, and therefore the content of the counter 32*c* is increased in a positive direction. Then, the pressure correction signal Sp is output from the pressure correction means 32, and accordingly, the pressure controller 10 can correct and control the jet pressures Pm and Ps of the main nozzle MN and sub-nozzles SNi increasing to ($Po + \delta P$) and maintain the arrival angle $\theta e$ at the set arrival angle $\theta eo$. Here, $\delta P$ represents the pressure correction quantity determined by the content of the counter 32*c* and expressed by the magnitude of the pressure correction signal Sp. When the counter 32*c* increases in a positive direction, the AND gate 32*b* is opened through the inverter 32*d* and the AND gates 33*a* and 33*b* are closed.

If the flying characteristic then lowers, the content of the counter 32*c* is likewise increased by the lagging signal S2 to increase the pressure correction quantity $\delta P$, and the pressure controller 10 can maintain the arrival angle $\theta e$ at the set arrival angle $\theta eo$.

If the flying characteristic of the weft yarn W assumes the up trend as shown in area E of FIG. 3, the leading signal Si instead of the lagging signal S2 is output but at that time, the AND gate 32*b* has been opened and the AND gate 33*a* has been closed and therefore the leading signal S1 can arrive at the subtraction terminal D of the counter 32*c* through the AND gate 32*b*. Accordingly, the pressure correction quantity $\delta P$ decreases and the jet pressures Pm and Ps also decrease, and the pressure controller 10 maintains the arrival angle $\theta e$ at the set arrival angle $\theta eo$.

Even in the case where the flying characteristic of the weft yarn W is varied in either direction as described above, either angle correction means 33 or pressure correction means 32 is actuated so that either the start angle $\theta s$ or the jet pressures Pm, Ps can be corrected and controlled through either the timing controller 20 or the pressure controller 10 to maintain the arrival angle $\theta e$ at the set arrival angle $\theta eo$.

Since the angle correction means 33 and the pressure correction means 32 are operated in the condition in which the other one of them does not output the pressure correction signal Sp and the angle correction signal Sa, at least one of the jet pressures Pm, Ps, and the start angle $\theta s$ are to coincide with the set pressure Po and the set start angle $\theta o$, which are the optimum values. In addition, correction is made only in a high direction from the optimum value of the jet pressures Pm, Ps or in a slow direction from the optimum value of the start angle $\theta o$.

When the content of counter 32*c* (33*c*) alternates from positive to negative (from negative to positive) radically, the pressure correction signal Sp (the angle correction signal Sa) is not output from this counter 32*c* (33*c*).

In the foregoing explanation, the leading signal S1 or the lagging signal S2 is output as one pulse signal each picking of the weft yarn W, and the contents of the counter 32*c* on the counter 33*c* are increased or decreased by a predetermined quantity every pulse. On the other hand, an increase and decrease in quantity every time of the counters 32*c* and 33*c* may be proportional to the magnitude of the arrival angle deviation $_{\Delta}\theta e$ calculated by the comparator 31*b*. For example, the comparator 31*b* may change the pulse width of the leading signal S1 and the lagging signal S2 according to the magnitude of the arrival angle $_{\Delta}\theta e$, and the counters 32*c* and 33*c* may decide the increase and decrease in quantity every time according to the pulse width thereof. Further, the arrival angle deviation $_{\Delta}\theta e$ is A/D converted and then introduced from the comparator 31*b* to the counters 32*c* and 33*c* so that the increase and decrease quantity proportional to the arrival angle deviation $_{\Delta}\theta e$ may be accumulated in the counters 32*c* and 33*c*. Furthermore, counters for counting the leading signals S1 and lagging signals S2 output every picking of the weft yarn W are provided so that the contents of the counters 32*c* and 33*c* may be increased and decreased whenever the leading signals S1 and lagging signals S2 are output by a predetermined quantity.

Other Embodiment

Figure 4:
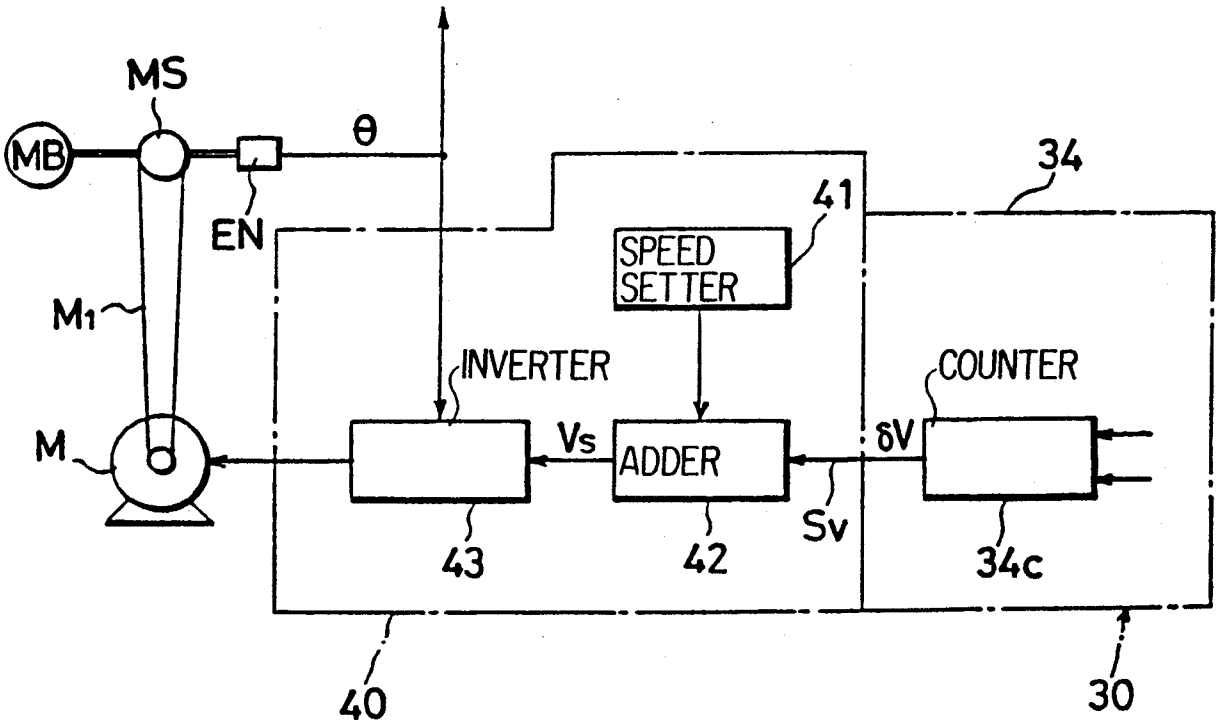
FIG. 4 is a systematic view of essential parts showing a further embodiment of the control device according to the present invention.

The angle correction means 33 of the condition setting section 30 shown in FIG. 1 can be replaced by a speed correction means 34 shown in FIG. 4, and the timing controller 20 replaced by a speed controller 40. Here, the speed correction means 34 has the same circuit configuration as that of the angle correction means 34, and a speed correction signal Sv is output from a counter 34*c* corresponding to the counter 33*c* to the speed controller 40. When the content of counter 34*c* is zero or negative, the speed correction signal 34 is not output from this counter.

The speed controller 40 comprises a speed setter 41 for setting and outputting a set speed Vo, an adder 42 for inputting the set speed Vo and a speed correction signal Sv, and an inverter 43 for controlling the speed of a main motor M by a command speed Vs from the adder 42. The main motor M drives a main shaft MS through a belt Ml, and a brake MB and an encoder EN are connected to the main shaft MS. The loom mechanical angle $\theta$ from the encoder EN is fed back to the inverter 43 and used as a speed feedback signal and is introduced into the arrival angle deviation detection means 31 and the timing controller 20 similarly to the previous embodiment. In this case, the timing controller 20 is independent of the condition setting section 30, and the picking operation is carried out at the fixed start angle $\theta s$ ($\theta s = \theta o$).

In the control operation by the present control device, when the flying characteristic of the weft yarn W becomes large, the content of the counter 34*c* of the speed correction means 34 is increased in a positive direction by the leading signal S1 from the deviation detection means 31 so that the speed correction signal Sv is output. Therefore, the speed controller 40 corrects and controls the command speed Vs to $Vs = Vo + \delta V$ so that the speed of the main motor M is corrected in a high direction. The reference character $\delta V$ denotes the speed correction quantity corresponding to the content of the counter 34*c*. So, if the lower optimum value is set in advance as the set speed Vo, the speed of the main motor M, that is, the operation speed of the loom is corrected in a high direction whereby the arrival angle $\theta e$ can be maintained at the set arrival angle $\theta eo$.

Thereafter, the speed correction means 34 can output the speed correction signal Sv on condition that the pressure correction means 32 does not output the pressure correction signal Sp to continue the stable picking, in exactly the same manner as that of the previous embodiment.

While in the foregoing explanation, the jet pressures Pm and Ps of the main nozzle MN and sub-nozzles SNi has been always in the relation of Pm=Ps, it is to be noted that the relation may be of Pm=a Ps (a is constant which is not 1) by insertion of a suitable ratio setting element into the input side of the control amplifiers 13, 13. It is further to be noted that the pressure regulating valves PVs may be disposed every group of the sub-nozzles SNi so as to realize the jet pressures which are different for each group. That is, the jet pressures of each picking nozzle formed from the main nozzle MN and sub-nozzles SNi may serve to control the pressure controller 10 collectively, or by the main nozzle MN alone or by dividing the sub-nozzle SNi into suitable groups.

While the timing controller 20 starts the operation of the picking members comprising the main nozzle MN, sub-nozzles SNi and engaging pin drive D1 at the time when the loom mechanical angle $\theta$ coincides with the start angle $\theta s$, it is to be noted that a suitable time difference may be provided in operation time of these picking members if necessary. That is, the operation of the main nozzle MN may be started prior by a predetermined time to the operation of the engaging pin drive D1 and vice versa. Further, the sub-nozzles SNi may be operated with a suitable time difference with respect to the operation time of the main nozzle MN.

The weft feeler ES may be disposed at a suitable position in the midst of woven fabrics instead of being disposed on the anti-picking side of woven fabrics. Furthermore, the weft feeler ES may be omitted, and the condition setting section 30 may use the loom mechanical angle $\theta$ when the picking length Wn from the release sensor D2 reaches a predetermined quantity, in place of the arrival angle $\theta e$.

As described above, according to this invention, there are provided a pressure controller, a timing controller (or a speed controller) and a condition setting section, said condition setting section comprising a deviation detection means, a pressure correction means and an angle correction means (or a speed correction means), said pressure correction means and said angle correction means (or speed correction means) being designed so that both correction means are not operated, an arrival angle deviation is input to either of said pressure correction means or said angle correction means, and one of them is not operated, the arrival angle deviation is input to the other operating correction means. So either pressure correction signal, angle correction signal (or speed correction signal) is not output whereby jet pressures controlled by the pressure controller and the start angle controlled by the timing controller (or the speed of the loom controlled by the speed controller) make it possible to provide a continuous stable picking operation in the state where at least one of them is maintained at the optimum value. Therefore, there are the excellent effects that in the operation, possible occurrence such as restriction cut, warp engagement and the like is very small, a sufficient scope is obtained, and an adequate air consumption can be realized.

What is claimed is:

1. A picking control device for a loom comprising a pressure controller for controlling jet pressure of a picking nozzle, a timing controller for controlling operation time of a picking member and a condition setting section, said condition setting section comprising a deviation detection means for calculating a deviation of an arrival angle from an arrival angle of filling yarns and a set arrival angle, a pressure correction means for outputting a pressure correction signal to the pressure controller for correcting a set pressure in response to the deviation of arrival angle calculated by said deviation detection means, and an angle correction means for outputting an angle correction signal to the timing controller for correcting a set start angle in response to the deviation of arrival angle calculated by said deviation detection means, and wherein said pressure correction means includes means for outputting a pressure correction signal in response to a condition in which the angle correction signal is not present, and said angle correction means includes means for outputting an angle correction signal in response to a condition in which the pressure correction signal is not present and wherein a leading signal is input only in said angle correction means and a lagging signal is input only in said pressure correction means in response to a condition in which neither the angle correction signal nor the pressure correction signal is present.

2. A picking control device for a loom comprising a pressure controller for controlling jet pressure of a picking nozzle, a speed controller for controlling speed of a loom, and a condition setting section, said condition setting section comprising a deviation detection means for calculating an arrival angle deviation from an arrival angle of weft yarn and a set arrival angle, a pressure correction means for outputting a pressure correction signal to said pressure controller for correcting a set pressure in response to said arrival angle deviation calculated by said deviation detection means, and a speed correction means for outputting a speed correction to said speed controller signal for correcting a set loom speed in response to said arrival angle deviation calculated by said deviation detection means, wherein said pressure correction means includes means for outputting a pressure correction signal in response to a condition in which the speed correction signal is not present, and said speed correction means includes means for outputting a speed correction signal in response to a condition in which the pressure correction signal is not present and wherein a leading signal is input only in said speed correction means and a lagging signal is input only in said pressure correction means in response to a condition in which neither the speed correction signal nor the pressure correction signal is present.

* * * * *